US008568215B1

(12) United States Patent
Tyler et al.

(10) Patent No.: US 8,568,215 B1
(45) Date of Patent: Oct. 29, 2013

(54) SYSTEM AND METHOD FOR MULTI-PLAYER ONLINE FARO GAME

(75) Inventors: Christie S. Tyler, Malibu, CA (US); Matthew J. Palmer, Los Angeles, CA (US); Travis J. Nash, New York, NY (US); Yehudi Mercado, Austin, TX (US); Eiso Kawamoto, Jr., San Francisco, CA (US); Craig R. Stewart, San Francisco, CA (US); Tara W. Packard, San Francisco, CA (US); Christian L. Straight, Palo Alto, CA (US); Omar Becerra, Rowland Heights, CA (US)

(73) Assignee: Gamedigs, LLC, Santa Monica, CA (US)

( * ) Notice: Subject to any disclaimer, the term of this patent is extended or adjusted under 35 U.S.C. 154(b) by 0 days.

(21) Appl. No.: 13/447,132

(22) Filed: Apr. 13, 2012

(51) Int. Cl.
*A63F 9/24* (2006.01)

(52) U.S. Cl.
USPC ..... 463/13; 463/31

(58) Field of Classification Search
USPC ..... 463/13, 31
See application file for complete search history.

(56) References Cited

U.S. PATENT DOCUMENTS 6,343,789 B1 2/2002 Webb
7,285,048 B2 10/2007 Karmarkar
2002/0027324 A1 3/2002 Webb
2003/0013509 A1* 1/2003 Efremov ..... 463/13
2005/0253337 A1 11/2005 Whiting
2006/0154725 A1* 7/2006 Glaser et al. ..... 463/37
2008/0217857 A1* 9/2008 Miller ..... 273/292
2009/0062008 A1 3/2009 Karmarkar
2009/0209312 A1 8/2009 Alderucci et al.
2009/0209321 A1 8/2009 Alderucci et al.
2011/0031694 A1 2/2011 Cohen
2011/0180996 A1 7/2011 Kok

OTHER PUBLICATIONS

"Wichita Faro", © 2007 Sean Gleeson, pp. 1-9, at http://www.online-games-zone.com/pages/casino/wichita-faro.php.*

* cited by examiner

*Primary Examiner* — Sunit Pandya
*Assistant Examiner* — Steve Rowland
(74) *Attorney, Agent, or Firm* — Jackson Walker L.L.P.; Christopher J. Rourk

(57) ABSTRACT

A game system comprising a plurality of card rank icons, each card rank icon represents one of a plurality of types of cards. A plurality of case keep icons, each case keep icon represents a number of cards of one rank that have been played in a game, wherein one or more of the case keep icons further comprises a denomination field displaying a denomination of a card associated with the case keep icon and a plurality of status indicators disposed around a periphery of the denomination field. A plurality of wager icons configured to be generated on a user display, each wager icon configured to graphically represent a bet on one or more of the card ranks by overlapping one, two or four of the card rank icons.

15 Claims, 7 Drawing Sheets

158
2 10B
4 10D
6 10F
8 10H
10 10J
Q 10L
A 10A
3 10C
5 10E
7 10G
9 10I
J 10K
K 10M
JOKER 10N
TIGER 10O
BUFFALO 10P
STATUS 160
144
HIGH CARD 142
ACE 102
KING 126
174
176
178
TWO 104
QUEEN 124
WIN 130
THREE 106
JACK 122
J-Q-K 152
50 140
LOSE 128
FOUR 108
TEN 120
7-8-9-10 150
25 138
FIVE 110
NINE 118
4-5-6 148
10 136
5 134
SIX 112
EIGHT 116
A-2-3 146
1 132
179
ACCOUNT 156

100
SEVEN 114
EXPERIENCE 154
QUICK BET 162
PERSONALIZATION 164
CHAT 166

SYSTEM AND METHOD FOR MULTI-PLAYER ONLINE FARO GAME

TECHNICAL FIELD

The present disclosure relates generally to online gaming, and more specifically to a system and method for a multi-player online Faro game that facilitates interaction between large numbers of players.

BACKGROUND OF THE INVENTION

The game of Faro originated in France in the 1600's, and involves betting between the dealer or "house" and one or more players. While the number of players is theoretically unlimited, for practical reasons, the number of players is limited to players that can place bets on the Faro game board. Because the odds of Faro are very close to being even between the dealer/house and the players, Faro is not commonly played, because of the potential for the dealer/house to lose large sums of that can only be recouped over a long period of time.

SUMMARY OF THE INVENTION

A game system is provided that includes a plurality of card rank icons, where each card rank icon represents one of a plurality of types of cards, such as each card in a standard deck of playing cards plus additional card rank icons for "special" cards such as the joker. A plurality of case keep icons is also provided, where each case keep icon represents a number of cards of one rank that have been played in a game. The case keep icons can include a denomination field that displays a denomination of a card associated with the case keep icon, and a status indicators disposed around a periphery of the denomination field, such as one for each card, where the status indicators change color or other appearance attributes as a card of the associated rank is played. A plurality of wager icons graphically represent a bet on one or more of the card ranks by overlapping one, two or four of the card rank icons, such as on an edge of the card, at the common edge between two cards, or at the four corners of four cards. In this manner, a large number of players can be accommodated in a game, which reduces the chance that the dealer/house will lose a large sum that cannot be quickly recouped.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
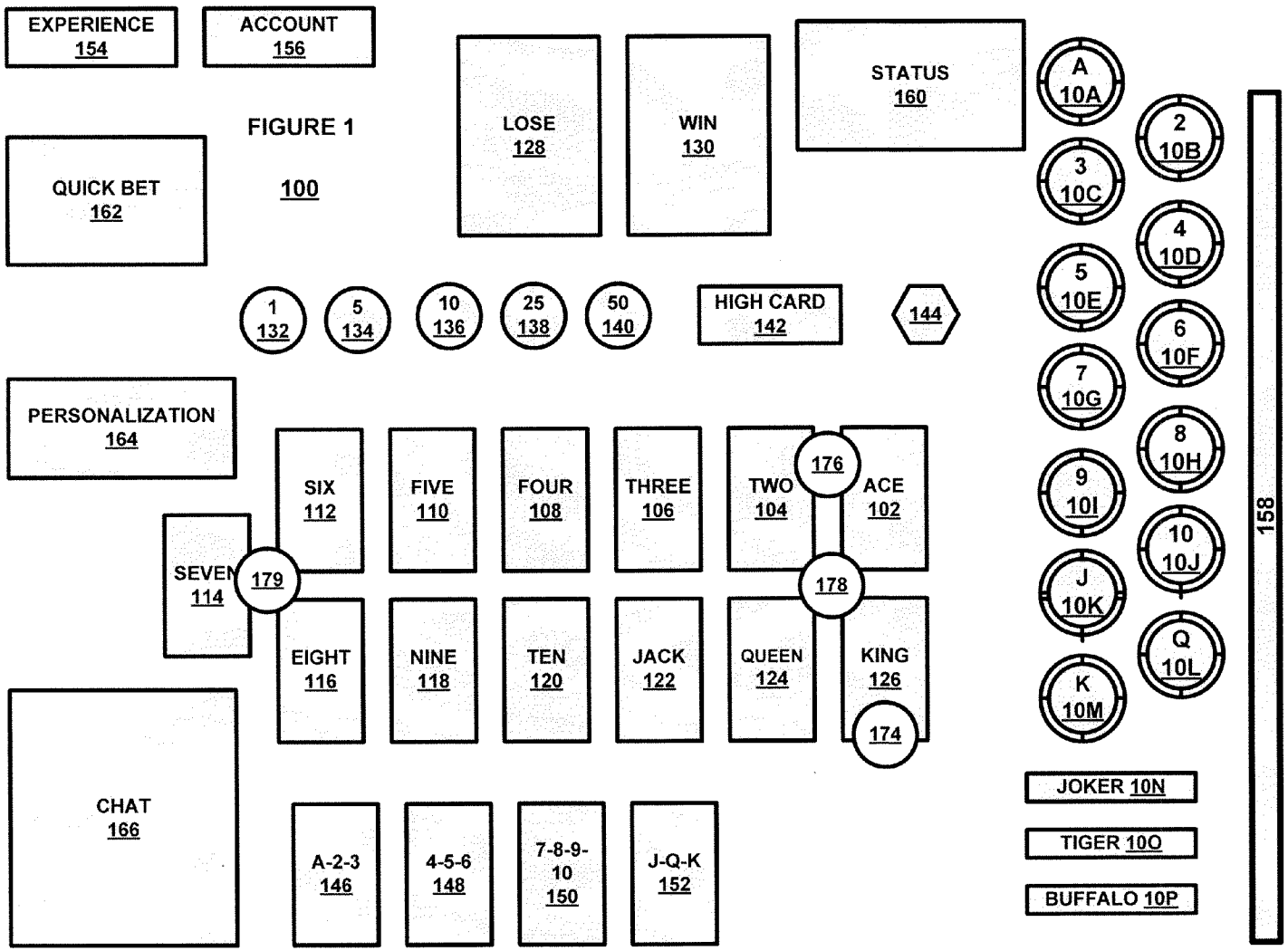
FIG. 1 is a diagram of an online Faro board in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of an online Faro board 100 in accordance with an exemplary embodiment of the present disclosure. Faro board 100 can be a graphic user interface generated on the video screen of a personal computer, the video screen of a cellular telephone, a television, or other suitable displays.

Faro board 100 includes card ranks 102 through 126, which allow bets for individual cards in a standard playing card deck to be made. Card ranks 102 through 126 can be implemented as independent objects having graphical and metadata attributes, such as to allow the appearance of each of card ranks 102 through 126 to be independently changed, to allow data to be associated with each of card ranks 102 through 126, and to provide other functionality as described in further detail herein. In the disclosed embodiment, bets are made by placing a wager on one, two or four cards, such as 1) ace 102, 2) ace 102 and two 104, or 3) ace 102, two 104, queen 124 and king 126. For a bet on a single card, the wager will be placed partially or entirely only on that card, such as shown by wager 174. For bets on two cards, the wager will be placed between the two cards so that the wager is partially on the two cards, such as shown by wager 176. For bets on three cards, the wager can be placed at the junction of the three cards such as 112, 114 and 116 so that the wager is partially on the three cards, such as shown by wager 179. For bets on four cards, the wager will be placed at the corner where the four cards meet, such as shown by wager 178. Wagers 174 through 178 can be implemented as independent objects having graphical attributes (such as a number of different graphical designs that are each associated with a different state) and metadata attributes (such as data associated with each state or methods that are used to interact with other objects or to navigate between states), or can be attributes of card ranks 102 through 126, such as to allow wagers to be placed on one or more of card ranks 102 through 126 in the exemplary manner shown by wagers 174 through 178. In one exemplary embodiment, a plurality of wager objects can be implemented to allow a user to place a wager at any desired location, and where the object associated with the wager at a selected location causes a graphic display to be generated and stores user identification data and wager data for each user that places a wager in that location. In another exemplary embodiment, each of card ranks 102 through 126 can have associated wager attributes, such as to generate a wager graphic for a location selected by a user and to store user identification data and wager data for each user that places a wager in that location.

In addition to wagers on adjacent cards, bets on groups of cards can also be provided, such as A-2-3 146, 4-5-6 148, 7-8-9-10 150 and J-Q-K 152, or other suitable groups of cards. In this exemplary embodiment, A-2-3 146 allows a player to place a bet on the ace, two and three card, 4-5-6 148 allows a player to place a bet on the four, five and six card, and so forth. Other suitable combinations of cards can also or alternatively be identified for wagers, such as all even cards, all odd cards, or all face cards. Group card ranks 146 through 152 can be implemented as independent objects having graphical and metadata attributes, such as to allow the appearance of each of group card ranks 146 through 152 to be independently changed, to allow data to be associated with each of group card ranks 146 through 152, and to provide other functionality as described in further detail herein.

Case keeps 10A through 10P are used to indicate the number of cards of each type that have been played. In one exemplary embodiment, the case keeps can display a number, such as 1-4 for the standard playing cards (ace 10A through king 10M) and 1 or 2 for the special cards (joker 10N, tiger 10O and buffalo 10P). In another exemplary embodiment, a graphical indicator can be used to allow the number of cards that have been played to be readily determined by a player. In this exemplary embodiment, the case keep for a corresponding card can be blank until a first card is played, and then subsequent cards can increment a suitable graphical indicator, as discussed further herein. Case keeps 10A through 10P can be implemented as independent objects having graphical and metadata attributes, such as to allow the appearance of each of case keeps 10A through 10P to be independently changed, to allow data to be associated with each of case keeps 10A through 10P, and to provide other functionality as described in further detail herein.

Chip markers 132 through 140 allow a player to place a wager by using a mouse, stylus or other suitable selecting device. In one exemplary embodiment, the player can select a chip marker, such as by placing a cursor over the chip marker having a selected denomination (such as $1, $5, $10, $25 or $50 as shown), and then by selecting a control on a mouse device, by tapping the chip marker, or in other suitable manners. In response, the graphic display corresponding to the selected chip marker can "float," to allow the player to move the chip marker to a selected wager location on the card ranks, as described above. The player can then select a control to place the wager, and the graphic display corresponding to the chip marker can transform into a graphic display for selecting the amount of the wager, as discussed further herein. Chip markers 132 through 140 can be implemented as independent objects having graphical and metadata attributes, such as to allow the appearance of each of chip markers 132 through 140 to be independently changed, to allow data to be associated with each of chip markers 132 through 140, and to provide other functionality as described in further detail herein.

High card rank 142 allows a player to place a wager on the high card being played as a winning card. In particular, two cards will be "placed" during play field in the lose play field 128 and win play field 130, such as by causing a graphic state of an object that is associated with lose play field 128 to represent a first randomly-selected card from a deck of available cards, and by causing a graphic state of an object that is associated with win play field 130 to represent a second randomly-selected card from a deck of available cards. The card image placed in the lose play field 128 will identify the losing card, and the card image placed in the win play field 130 will identify the winning card. As such, the winning card can either be a low card or a high card, and a wager placed in high card rank 142 allows a user to bet that a high card will be the winning card for a given hand. Likewise, by placing the "copper" marker on a wager in high card rank 142 as described below, the user can bet that a low card will be the winning card for a given hand. High card rank 142 can be implemented as an independent object having graphical and metadata attributes, such as to allow the appearance of high card rank 142 to be independently changed, to allow data to be associated with high card rank 142, and to provide other functionality as described in further detail herein.

Hexagonal field 144 represents the "copper" marker for a Faro game. In one exemplary embodiment, hexagonal field 144 can be implemented as an independent object having graphical and metadata attributes, such as to allow the appearance of hexagonal field 144 to be independently changed, to allow data to be associated with hexagonal field 144, and to provide other functionality as described in further detail herein. In another exemplary embodiment, hexagonal field 144 can be an attribute of different objects, such as card ranks 102 through 126, card ranks 146 through 152, high card rank 142, or other suitable objects. Hexagonal field 144 signifies that the wager that it is "placed" on is reversed. In one exemplary embodiment, when hexagonal field 144 is placed on a wager on high card rank 142, it reverses the wager such that the player wins the wager if the winning card is the low card (or conversely, if the losing card is the high card). Likewise, the copper marker can be placed on wagers on individual card ranks 102 through 126, group card ranks 146 through 152, or other in other suitable locations.

Experience field 154 and account field 156 provide the experience points and account balance for the player that is utilizing the graphical interface on which Faro board 100 is displayed. In one exemplary embodiment, a player will log on to the player's account to access Faro board 100, and player-specific information will be displayed in selected fields, such as experience field 154 and account field 156, which can be implemented as independent objects having graphical and metadata attributes, such as to allow the appearance of each of experience field 154 and account field 156 to be independently changed, to allow data to be associated with each of experience field 154 and account field 156, and to provide other functionality as described in further detail herein.

Hand counter 158 displays the current hand being played. In one exemplary embodiment, the Faro game displayed on Faro board 100 can use data that represents a single standard playing card deck of 52 cards, with six additional special cards, such as two joker cards, two tiger cards and two buffalo cards. In this exemplary embodiment, a first card (sometimes referred to as the "soda" card) will be randomly selected from the deck of available cards, will be displayed, and will then be "discarded" prior to the first hand, such as by changing a state associated that card from an available state to an unavailable state. Thereafter, play will proceed with sets of two cards being "dealt" to the lose play field 128 and win play field 130, such that a predetermined number of hands will be played until the last cards in the deck are played. In one exemplary embodiment, as cards are randomly selected for play, a data field associated with each card can be changed to indicate that the card is either in play or has already been played and is therefore no longer available. Hand counter 158 is used to indicate the current hand, and can be implemented as an object having graphical and metadata properties.

Status field 160 is used to display the game status, such as the time remaining until the game starts, the time remaining until the next hand is "dealt," or other suitable game status information. Status field 160 can be implemented as an object having graphical and metadata properties.

Quick bet field 162 includes one or more controls to allow a player to place one or more wagers without having to make individual wager selections. In one exemplary embodiment, quick bet field 162 can include controls for clearing all wagers where wagers remain on the table after a hand is dealt, for undoing the last wager, for replaying the same wager as was played for the previous hand, for doubling the amount of all wagers, for playing the same wagers as another player, or other suitable controls. Quick bet field 162 can be implemented as an object having graphical and metadata properties.

Personalization field 164 displays personalization data or images for a player. In one exemplary embodiment, the player may buy a food or drink icon to be displayed in personalization field 164, another player may buy a food or drink icon to be displayed in the field for the player viewing Faro board 100, or other suitable personalization data can be displayed. Personalization field 164 can also or alternatively be configured by the player to display data from other games, data that identifies a winning player or other suitable selected data. Personalization field 164 can be implemented as an object having graphical and metadata properties.

Chat field 166 can display messages between players, messages that are broadcast to all players or other suitable messages. In one exemplary embodiment, a player can select one or more controls to configure chat field 166, such as to block messages from selected other players. Chat field 166 can be implemented as an object having graphical and metadata properties.

In operation, Faro board 100 allows a user to place wagers in a multi-player online faro game and to interact with other players, as described further herein.

Figure 2:
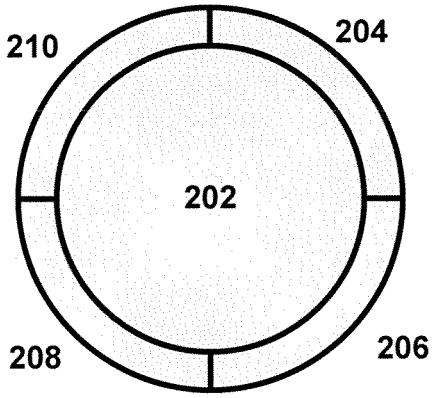
FIG. 2 is a diagram of a case keep in accordance with an exemplary embodiment of the present disclosure.

FIG. 2 is a diagram of a case keep 200 in accordance with an exemplary embodiment of the present disclosure. Case keep 200 is a graphic interface control for allowing a player to readily determine the number of cards that have been played. Case keep 200 can be implemented as one or more objects having associated graphical and metadata properties.

Case keep 200 includes denomination field 202, which displays the denomination of the card associated with case keep 200. In one exemplary embodiment, denomination field 202 can display the denomination of a card from a standard playing card deck, such as ace, two, three and so forth. In another exemplary embodiment, denomination field 202 can be used to display a special card indicator, such as a joker, a tiger, a buffalo or other suitable cards.

Case keep 200 also includes status indicators 204 through 210. In one exemplary embodiment, as a card of the denomination shown in denomination field 202 is "played," such as by randomly selecting the card value from a set of available card values, one of the status indicators 204 through 210 will change state, such as by changing color or other fill characteristics. In this exemplary embodiment, each of the status indicators 204 through 210 can be darkened until a first card of the denomination shown in the denomination field is played, at which point a first status indicator, such as status indicator 204, can change state from dark to light. Likewise, case keep 200 can be hidden until the first card of denomination field 202 is played, such as by changing a display state of an object associated with case keep 200. As each successive card of the denomination field 202 is played, progressive status fields can change state from dark to light, such as in a clockwise order with status field 206 for the second card, status field 208 for the third card and status field 210 for the fourth card, in a counter-clockwise order or in other suitable sequences. Likewise, case keep 200 can be hidden from view after all four cards associated with denomination field 202 have been played, where suitable.

Figure 3:
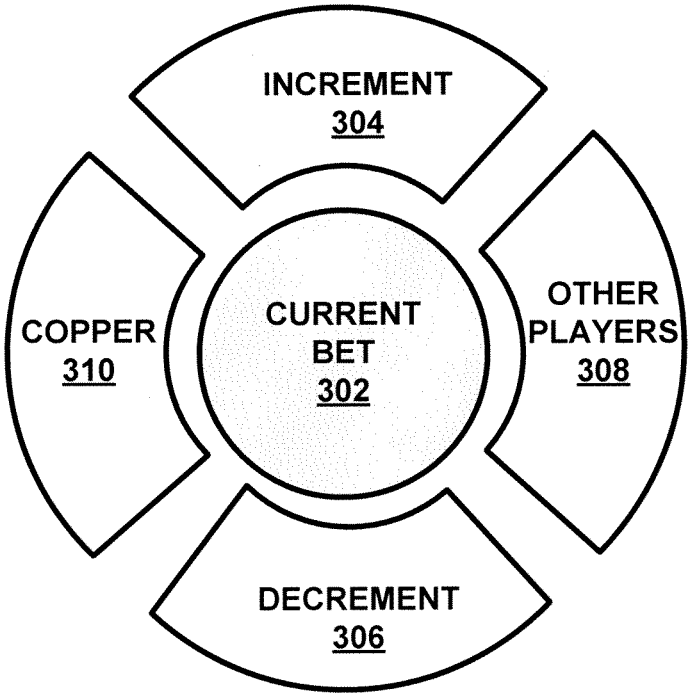
FIG. 3 is a diagram of a wager control in accordance with an exemplary embodiment of the present disclosure.

FIG. 3 is a diagram of a wager control 300 in accordance with an exemplary embodiment of the present disclosure. Wager control 300 allows a player to place a wager in conjunction with Faro board 100, to see the number or amount of wagers placed by others, and to perform other suitable functions. Wager control 300 can be implemented as one or more objects having associated graphical and metadata properties.

Wager control 300 includes current bet field 302, which displays an amount of a current bet that has been selected by a player. Wager control 300 also includes increment control 304 and decrement control 306, which are diametrically opposed at locations around the circumference of current bet field 302. A user can select increment control 304 or decrement control by placing a cursor over one of the controls and selecting a control on a mouse device, by tapping a touch sensor screen with a stylus, by selecting an up or down arrow on a keyboard, or in other suitable manners. In response, the amount of the wager shown in current bet field 302 can increment or decrement accordingly, such as by using one or more methods associated with an object that generates wager control 300 or current bet field 302.

Wager control 300 also includes other players field 308, which displays the total amount bet by other players for wagers of the same denomination as that shown in current bet field, for wagers of the same denomination associated with wager control 300, or for other suitable amounts. In one exemplary embodiment, other players field 308 can be an object, an attribute of an object associated with wager control 300, or can be implemented in other suitable manners.

Figure 4:
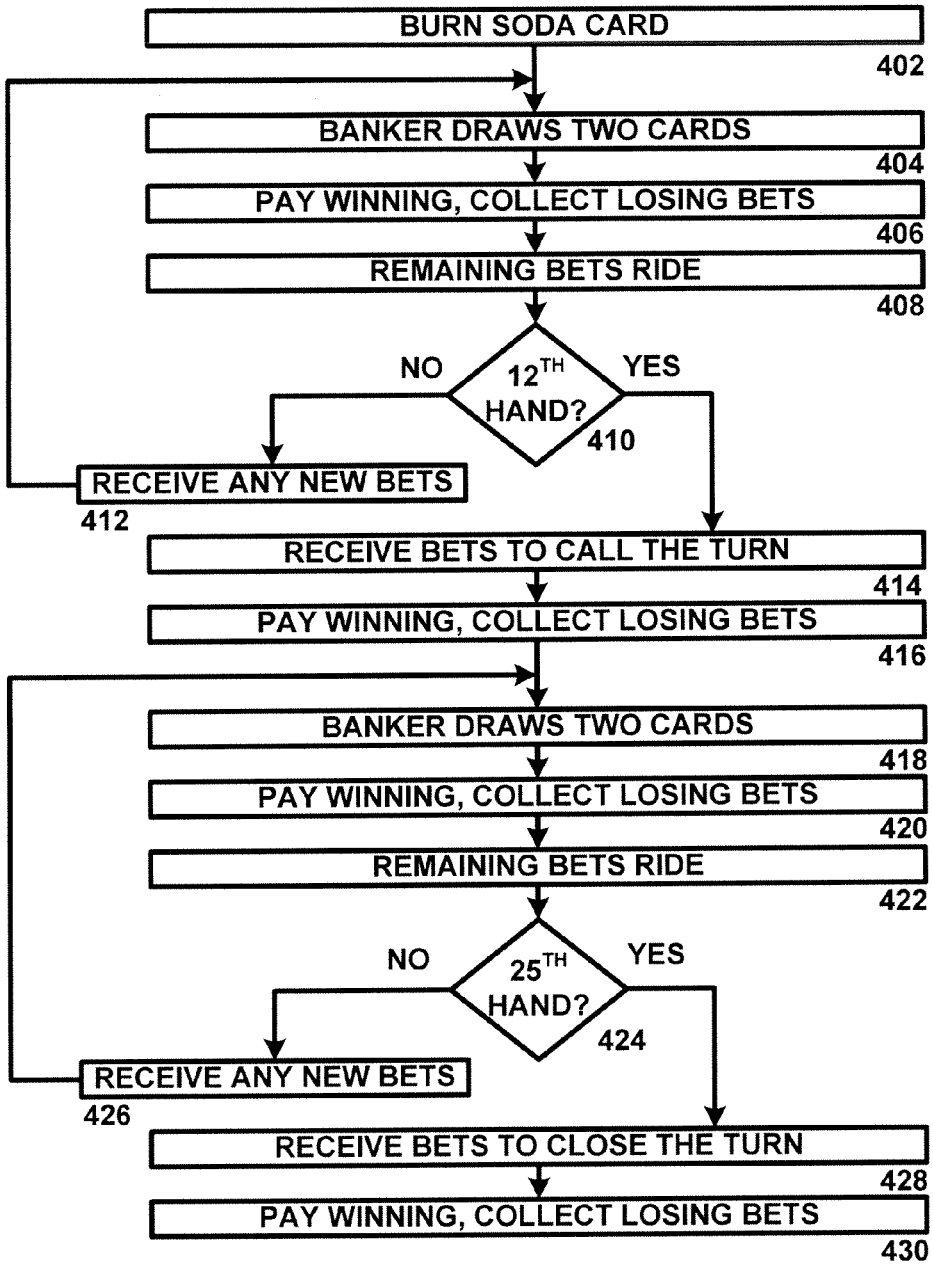
FIG. 4 is a flow chart of an algorithm for conducting a game in accordance with an exemplary embodiment of the present disclosure.

FIG. 4 is a flow chart of an algorithm 400 for conducting a game in accordance with an exemplary embodiment of the present disclosure. Algorithm 400 can be implemented in hardware, such as by using a plurality of integrated logic devices, or in a suitable combination of hardware and software, such as using software operating on a general purpose processor platform. Algorithm 400 can also or alternatively be implemented as a state diagram, where state transitions as shown, additional state transitions or alternative state transitions can be provided, as discussed herein.

Algorithm 400 begins at 402, where a simulation of a soda card being burned is conducted. In one exemplary embodiment, a variable representing a card in a deck of playing cards can be randomly selected from a set of variables that represent the available cards, and the associated card can be eliminated from the set of variables, such as by changing a status indicator that is associated with the card from a first state that indicates availability to a second state that indicates unavailability. A graphic can be generated to allow a user to see the eliminated card, and a case keep graphic can be modified to identify the card that has been selected. The algorithm then proceeds to 404.

At 404, a simulation of a banker drawing two cards from the deck of cards is conducted. In one exemplary embodiment, two random selections can be made from the set of variables that represent available cards, and the associated cards can be eliminated from the set of variables, such as by changing status indicators that are associated with the cards from a first state that indicates availability to a second state that indicates unavailability. A graphic can be generated to allow a user to see the drawn cards, and case keep graphics can be modified to identify the cards that have been selected. The algorithm then proceeds to 406.

At 406, winning bets are paid and losing bets are collected. In one exemplary embodiment, winning bets can be paid where a player has placed a bet on a card that is drawn in the win play field of a Faro game, such as where the bet is wager that is placed entirely on the winning card, that is placed on the winning card and an adjacent card, on one corner of the winning card and three other adjacent cards, on a card group that includes the winning card, or in other suitable manners. Likewise, a losing bet can be collected where a player has placed a bet on a card that is drawn in the lose play field of a Faro game, such as where the bet is a wager that is placed entirely on the losing card, that is placed on the losing card and an adjacent card, on one corner of the losing card and three other adjacent cards, on a card group that includes the losing card, or in other suitable manners. In another exemplary embodiment, a winning bet can occur when a special card (i.e. not a standard card) is selected for the win play field of a Faro game and a standard card is selected for the lose play field, such as where every bet is paid as a winning bet, and a losing bet can occur when a special card is selected for the lose play field and a standard card is selected for the win play field, such as where every bet is collected as a losing bet. In another exemplary embodiment, winning and losing bets can be determined based on a coin flip, such as where the card in the win field is the same as the card in the lose field, or on special rules regarding the relationship between special cards, such as where a tiger card beats a joker card, a buffalo card beats a tiger card, and a joker card beats a buffalo card. Likewise, other suitable rules can be applied to determine winning and losing bets, such as rules for the processing of wagers that are placed on both the winning card and the losing card. The winning bets can be placed on the original wager (such that the total amount remains on the original wager), the winning bets can be returned to the player's wallet/account, or other suitable processes can be also or alternatively used. The algorithm then proceeds to 408.

At 408, remaining bets can be allowed to "ride" or remain where they have been placed for the current hand. In another exemplary embodiment, remaining bets can be returned to the player or other suitable processes can be used. The algorithm then proceeds to 410, where it is determined whether the $12^{th}$ hand has been played. In one exemplary embodiment, the 12th hand can be the middle hand of the game, such as where the game is a Faro game and the deck includes a standard deck of 52 cards plus six special cards. If it is determined that the $12^{th}$ hand has not been played, the algorithm proceeds to 412 where players are allowed to place additional bets. In addition, a timer can be activated and the remaining time for placing additional bets before the next hand is dealt can be displayed. The algorithm then returns to 404. If it is determined that the $12^{th}$ hand has been played at 410, the algorithm proceeds to 414. Likewise, other suitable numbers of hands can be selected for 410, such as where there are a greater or lesser number of cards in the deck, or where additional wagering opportunities are provided as described further herein.

At 414, an additional wagering opportunity is provided to allow players to "call the turn." In this exemplary embodiment, players can elect to wager on the order of the next three cards to be drawn in a Faro game, such as where the next three cards are drawn without disclosing the order to the players. The players can then place a wager on one of the possible order combinations. For example, if the next three cards are 2, 3 and 4, the possible order combinations are 2-3-4, 2-4-3, 3-2-4, 3-4-2, 4-2-3 and 4-3-2, such that a player can place a wager on one of the six possible outcomes. Likewise, different procedures can be used in cases where two or three of the cards have the same rank, such as to substitute calling the order of the color of the cards (e.g. red or black). After any bets to call the turn are placed at 414, the algorithm proceeds to 416, where winning bets are paid and losing bets are collected. The algorithm then proceeds to 418.

At 418, a simulation of a banker drawing two cards from the deck of cards is conducted. The algorithm then proceeds to 420. At 420, winning bets are paid and losing bets are collected. The algorithm then proceeds to 422. At 422, remaining bets are allowed to ride, or can alternatively be returned to the players. The algorithm then proceeds to 424, where it is determined whether the $25^{th}$ hand has been played.

In one exemplary embodiment, the $25^{th}$ hand can be the last hand of the game, such as where the game is a Faro game and the deck includes a standard deck of 52 cards plus six special cards. If it is determined that the $25^{th}$ hand has not been played, the algorithm proceeds to 426 where players are allowed to place additional bets. In addition, a timer can be activated and the remaining time for placing additional bets before the next hand is dealt can be displayed. The algorithm then returns to 418. If it is determined that the $25^{th}$ hand has been played at 424, the algorithm proceeds to 428. Likewise, other suitable numbers of hands can be selected for 424, such as where there are a greater or lesser number of cards in the deck, or where additional wagering opportunities are provided as described further herein.

At 428, an additional wagering opportunity is provided to allow players to "close the turn." In this exemplary embodiment, players can elect to wager on the order of the last three or four cards to be drawn in a Faro game, such as where the last three or four cards are drawn without disclosing the order to the players. The players can then place a wager on one of the possible order combinations. For example, a player can place a wager on one of the six possible outcomes for the last three cards (where all three cards are different), or one of 24 possible outcomes for the last four cards (where all four cards are different).

In addition, where players are presented with the option of betting on the order of the last three or four cards, additional processes can be used to prevent collusion between players in a multiplayer game. For example, a first player could elect to bet on the order of three of the last four card (where the odds are 6:1), and a second player working in collusion with the first player could elect to bet on the order of the last four cards (where the odds are 24:1). In this exemplary embodiment, the first player could wait to see the options that are presented for choosing three of the last four cards, and could then notify the second player using the game messaging features of the three cards, to allow the second player to know the identity of the last card (and thus to realize odds of 6:1 on a bet that pays off at higher odds, such as 20:1). To prevent collusion, players that elect to bet on three cards can be presented with a random set of three of the last four cards. For example, if the last four cards are ace-two-jack-seven, then a first player who elects to bet on the order of only three cards can be presented with ace-two-jack, and a second player who elects to bet on the order of only three cards can be presented with two-jack-seven, such that the order of the last three cards within the set of the last four cards is indeterminate. Likewise, other suitable sets of three of the last four cards can be chosen, such as ace-jack-seven and ace-two-jack, in this exemplary embodiment. In this manner, players can elect to bet on the order of three of the last four cards without creating an opportunity for collusion.

After any bets to close the turn are placed at 428, the algorithm proceeds to 430, where winning bets are paid and losing bets are collected.

In operation, algorithm 400 controls the sequence of game play for a multiplayer online game such as Faro. Algorithm 400 allows a large number of players to play during a single game, and provides additional wagering opportunities.

Figure 5:
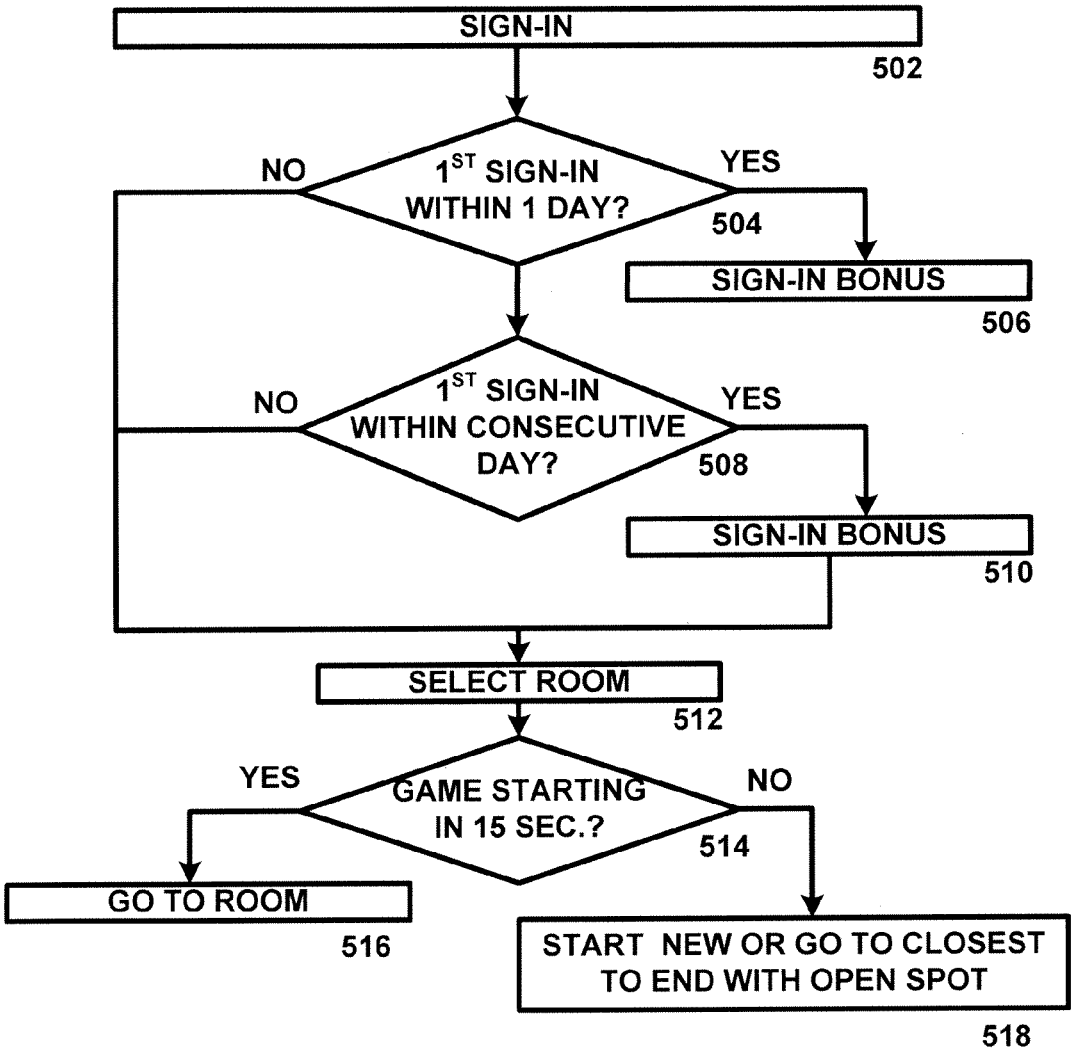
FIG. 5 is a flow chart of an algorithm for conducting a metagame in accordance with an exemplary embodiment of the present disclosure.

FIG. 5 is a flow chart of an algorithm 500 for conducting a metagame in accordance with an exemplary embodiment of the present disclosure. Algorithm 500 can be implemented in hardware, such as by using a plurality of integrated logic devices, or in a suitable combination of hardware and software, such as using software operating on a general purpose processor platform. Algorithm 500 can also or alternatively be implemented as a state diagram, where state transitions as shown, additional state transitions or alternative state transitions can be provided, as discussed herein.

Algorithm 500 begins at 502, where a user sign-in is performed. In one exemplary embodiment, the user sign-in can take place after a user has accessed a password protected account, such as when the user activates an application that is accessible from the password protected account. The algorithm then proceeds to 504.

At 504, it is determined whether the user has signed in within the last 24 hour period. If it is determined that the user has not signed in within the last 24 hour period, the algorithm proceeds to 512, otherwise, the algorithm proceeds to 506 where a daily sign-in bonus is awarded. The algorithm then proceeds to 508.

At 508, it is determined whether the user has signed in for two or more consecutive 24-hour periods. If it is determined that the user has not signed in for two or more consecutive 24-hour periods, the algorithm proceeds to 512, otherwise, the algorithm proceeds to 510 where an additional sign-in bonus is awarded, such as by adding a credit to the user's account balance, by awarding a game token (such as an item in a collection, a drink icon, a food icon or other suitable game tokens), a game incentive (such as a power-up, an extra number of games that can be played or other suitable incentives), or in other suitable manners. In one exemplary embodiment, the sign-in bonus can be data that is added to a data field associated with the user's account profile. In this exemplary embodiment, the user's account profile can include a number of data fields in a database or other suitable data structures that define the parameters of a user, such as an account balance, an experience point balance, collection items that are owned by the user, screen display items that are owned by the user, personalization settings for the user, or other suitable data. In addition, one or more objects, such as on-screen display graphic objects, can import data from the user profile, such as to display the user's experience level, to generate on-screen personalization display details, or for other suitable purposes. The sign-on bonus can modify data in the user's account profile, can associate an object with the user's account for a predetermined period of time, or can be implemented in other suitable manners. The algorithm then proceeds to 512.

At 512, a room selection is made by the user, where a room is a graphic display that identifies a game play state having predefined rules. The predefined rules can include rules that affect the game play, rules that affect the graphic user interface associated with the room, or other suitable rules. In one exemplary embodiment, the room selection can be made by generating an on screen display of available rooms, including rooms that the user is unable to access because the user's account profile data does not have a required level of experience, a required number of game tokens, a required number of collection items, or other suitable requirements. In this manner, a user can be provided with an incentive to obtain the additional requirements so as to be able to access such off-limit rooms. In this exemplary embodiment, an attempt by the user to access an off-limit room is denied. After the user selects a valid room that is accessible to the user, the algorithm proceeds to 514.

At 514, it is determined whether there is a game starting in the selected room within a predetermined period of time, such as 15 seconds. If it is determined that there is a game starting, the algorithm proceeds to 516 and the user is placed in the game within the room. In one exemplary embodiment, a game can have a number of controls or attributes, such as an object that identifies players that are participating in the game, a register that contains player identification numbers/alphanumeric strings associated with players that are participating in the game or other suitable controls or attributes. In this exemplary embodiment, the player identification number/alphanumeric string can be added to a data field of the object, the register, or other suitable data controls to allow the player to participate in the game.

Likewise, if it is determined at 514 that no game is starting within the predetermined period of time, the algorithm proceeds to 518, where a new game is started, the player is placed into an active game with an open spot, or other suitable processes are implemented. In one exemplary embodiment, a new game can be instantiated based on available server capacity, allocated server capacity for an expected number of games (based cc historical activity for the time of day and day of week), the number of players available to play in the new game, or in other suitable manners. Likewise, a player can be placed into an existing game (such as a game where the player will not be able to immediately participate under the game rules) if there are open spots in such games (such as due to players leaving the game or by allocating additional slots for new players in a game), if there are not enough players to start a new game, or in other suitable manners.

Figure 6:
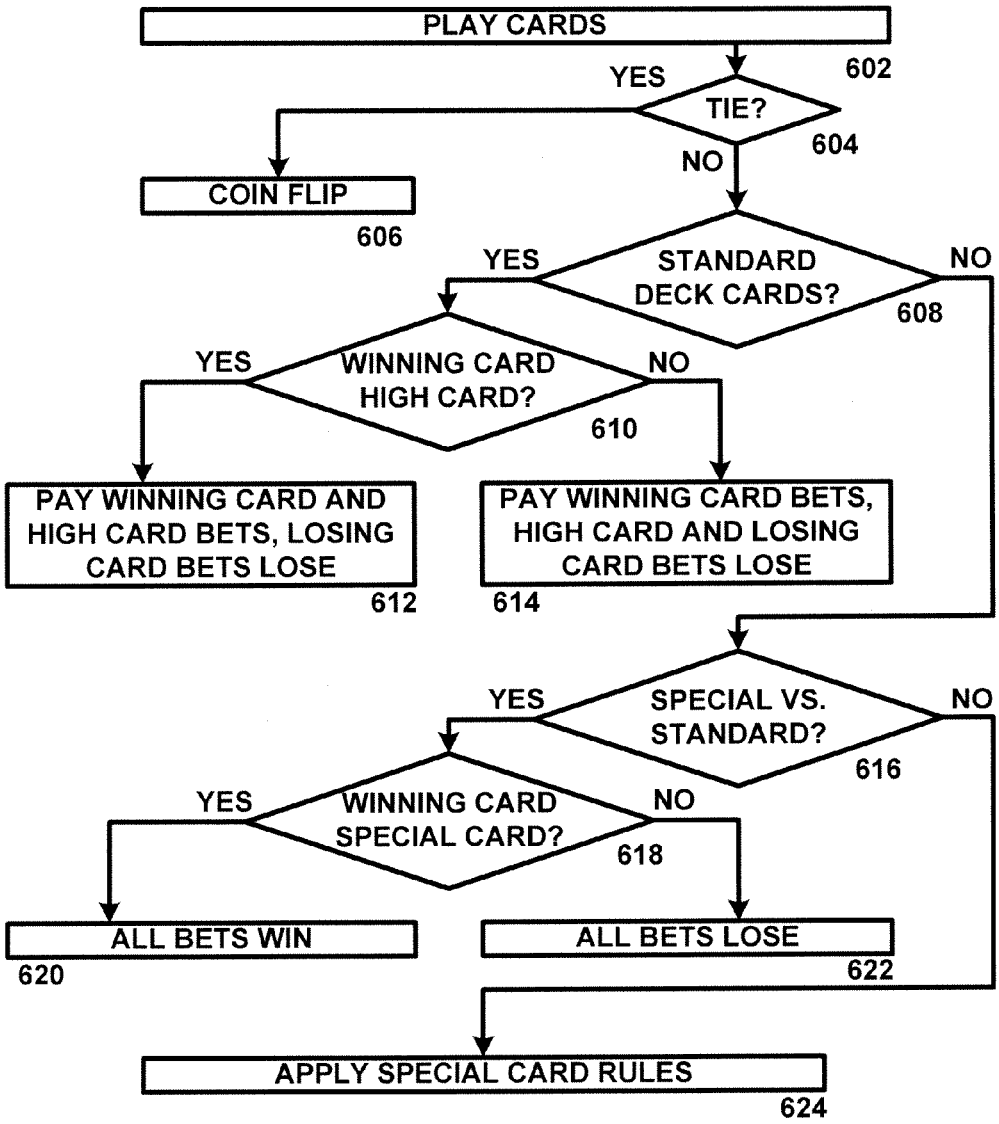
FIG. 6 is a flow chart of an algorithm for conducting a Faro game in accordance with an exemplary embodiment of the present disclosure.

FIG. 6 is a flow chart of an algorithm 600 for conducting a Faro game in accordance with an exemplary embodiment of the present disclosure. Algorithm 600 can be implemented in hardware, such as by using a plurality of integrated logic devices, or in a suitable combination of hardware and software, such as using software operating on a general purpose processor platform. Algorithm 600 can also or alternatively be implemented as a state diagram, where state transitions as shown, additional state transitions or alternative state transitions can be provided, as discussed herein.

Algorithm 600 begins at 602, where two cards are played. In one exemplary embodiment, two cards can be randomly selected from a deck of available cards, such as where a data register holds identifiers associated with the available cards and register entries are randomly selected, or in other suitable manners. After the two random selections are made, the associated register entries are deleted, or the two selected cards are otherwise eliminated from the deck of available cards. A graphic can be generated for each of the two cards in an associated display field, such as to display a first card graphic in a winning card display field, and to display a second card graphic in a losing card display field. The algorithm then proceeds to 604.

At 604, it is determined whether the two selected cards have the same value, such that the cards are a tie. If it is determined that the two selected cards have the same value, the algorithm proceeds to 606, where the winning card is determined using a coin flip or in other suitable manners. In one exemplary embodiment, the coin flip can be a user display animation sequence that simulates a coin being flipped, where the result (i.e. heads or tails) is randomly determined. In this exemplary embodiment, any players that have wagered on the card value can win if the outcome of the coin flip has a first predetermined value (e.g. head), and can lose if the outcome of the coin flip has a second predetermined value (e.g. tail). If it is determined at 604 that the two cards do not have the same value, the algorithm proceeds to 608.

At 608, it is determined whether two standard deck cards have been drawn (e.g. two through ace). If two standard deck cards have been drawn, the algorithm proceeds to 610, where it is determined whether the card that has been allocated to the winning card field is the high card of the two drawn cards. If the winning card is the high card, the algorithm proceeds to 612 where winning card and high card bets are paid, and losing card bets are collected. In one exemplary embodiment, an object associated with the winning card rank can maintain a list of users that have placed a wager on the winning card rank and the associated wagers for each user, and an object associated with the high card rank and an object associated with the losing card rank can likewise maintain a list of users that have placed wagers on those ranks, so as to allow winning and losing bets to be readily identified and processed. Other suitable configurations can also or alternatively be used. If it is determined that the winning card is not the high card, the algorithm proceeds to 614, where the winning card bets are paid and the losing card bets and high card bets are collected.

If it is determined at 608 that two standard deck cards have not been drawn, the algorithm proceeds to 616 where it is determined whether a special card and a standard deck card have been drawn, in which case the algorithm proceeds to 618. At 618, it is determined whether the winning card is a special card. If the winning card is the special card, the algorithm proceeds to 620, and all bets on the board are processed as winning bets. If the winning card is not the special card, then all bets on the board are processed as losing bets.

If it is determined at 616 that a special card and a standard card have not been drawn, then the two drawn cards must both be special cards and are also not matching cards, and the algorithm proceeds to 624, where special rules are applied to determine the winning card. In one exemplary embodiment, the special rules can provide for a first card type such as a tiger card to beat a second card type such as a joker card, a third card type such as a buffalo card to beat the first card type, and for the second card type to beat the third card type, or other suitable rules can also or alternatively be applied.

Figure 7:
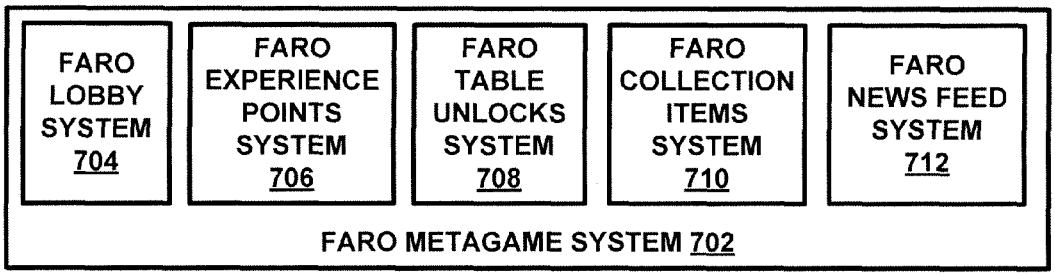
FIG. 7 is a diagram of a system for providing Faro metagame functionality in accordance with an exemplary embodiment of the present disclosure.

FIG. 7 is a diagram of a system 700 for providing Faro metagame functionality in accordance with an exemplary embodiment of the present disclosure. System 700 includes Faro metagame system 702, Faro lobby system 704, Faro experience points system 706, Faro table unlocks system 708, Faro collection items system 710 and Faro news feed system 712, each of which can be implemented in hardware or a suitable combination of hardware and software, and which can be one or more software systems operating on a general purpose processing system. As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications or on two or more processors, or other suitable software structures. In one exemplary embodiment, software can include one or more lines of code or other suitable software structures operating in a general purpose software application, such as an operating system, and one or more lines of code or other suitable software structures operating in a specific purpose software application.

Faro metagame system 702 provides metagame functionality for a faro game, such as to allow users to be provided with incentives for playing, to allow users to form teams, to allow users to chat during a game and for other suitable purposes.

Faro lobby system 704 allows a user to enter a lobby that defines a number of game areas and that provides other functionality. In one exemplary embodiment, Faro lobby system 704 can generate a user interface on a web browser screen, on a cellular telephone screen, in an application (such as an online social network application) or in other suitable manners that includes a plurality of user-selectable controls that allow a user to select a room that defines a Faro game having a plurality of parameters, to purchase items or account credits, to form teams with other users, to communicate with other users or to perform other suitable functions. Each of the functions associated with Faro lobby system 704 can be implemented as an object that has associated graphical and metadata parameters, where the graphical parameters generate user controls and the metadata parameters provide access to other game systems or other methods associated with the object.

Faro experience points system 706 tracks experience points for players in a Faro game. In one exemplary embodiment, Faro experience points system 706 can award additional experience points for predetermined Faro game rooms, for winning predetermined types of games, for having a predetermined number of consecutive winning hands, or for other suitable game accomplishments.

Faro table unlocks system 708 controls user access to rooms. In one exemplary embodiment, Faro table unlocks system 708 can interface with a plurality of room objects and can cause a graphic display associated with each room object to change state depending on the account parameters of the user that is currently viewing a lobby graphic interface that includes the room objects. In this exemplary embodiment, if a user attempts to select a room graphic that the user does not have access to, Faro table unlocks system 708 can generate an on-screen notification that alerts the user of the conditions or parameters that are required for obtaining access to the selected room, such as a number of experience points that are required to access the room, a number of collection items that must be obtained, or other suitable conditions or parameters.

Faro collection items system 710 allows users to collect items that have been defined within the Faro game system. In one exemplary embodiment, collection items can be defined that can be purchased, that are won during game play, that are randomly awarded during game play, or in other suitable manners, where the collection items can be implemented as objects having associated graphical and metadata parameters. In this exemplary embodiment, the user can access a control from the lobby or from other suitable user interfaces that allows the user to see the collection items that the user has acquired, the collection items can be displayed on selected user interfaces, or other suitable processes or systems can be used to allow the user to see the collection items that the user has acquired, the collection items that the user has not acquired, or other suitable collection items.

Faro news feed system 712 provides data sharing functionality for a Faro game. In one exemplary embodiment, Faro news feed system 712 can allow a user to designate one or more communications channels for transmitting data regarding the user, such as whether the user is presently playing the Faro game, whenever the user achieves an accomplishment within the Faro game such as winning a game or collection item, or other suitable information related with the user and the Faro game. In another exemplary embodiment, Faro news feed system 712 can allow a user to configure their user interface to receive news feeds from other systems, such as other games, alerts posted by other players (either within the Faro game or in other systems), or other suitable data.

Figure 8:
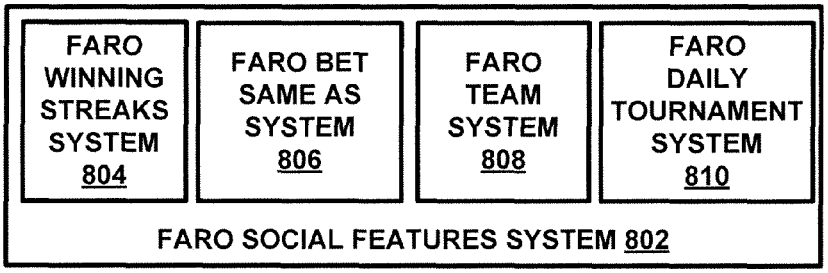
FIG. 8 is a diagram of a system for providing social features within a Faro game in accordance with an exemplary embodiment of the present disclosure.

FIG. 8 is a diagram of a system 800 for providing social features within a Faro game in accordance with an exemplary embodiment of the present disclosure. System 800 includes Faro social features system 802, Faro winning streaks system 804, Faro bet same as system 806, Faro team system 808 and Faro daily tournament system 810, each of which can be implemented in hardware or a suitable combination of hardware and software, and which can be one or more software systems operating on a general purpose processing system.

Faro social features system 802 provides one or more social features for allowing players in a multiple player Faro game to interact with each other. In a multiple player game environment that allows large numbers of players to participate in a single game, interaction between the players can be difficult to coordinate, because of the large number of players. For example, if a chat area is provided, then the number of chat messages posted can act as an impediment to communications, because the pace at which the chat messages are posted can be faster than the ability of players to read the messages. Faro social features system 802 controls the default on-screen data settings and provides additional user-configurable settings, so as to allow the users to communicate and otherwise interact socially without creating an environment where the large number of players in any game prohibits effective communications or social interactions.

Faro winning streaks system 804 generates graphical data displays that alert all players in a Faro game of players that have won a predetermined number of hands or games, or that provides other suitable functionality. In one exemplary embodiment, Faro winning streaks system 804 can generate an on-screen display that identifies the user name of a player that has won a predetermined number of prior hands in a game, a predetermined amount of money, or other suitable accomplishments within the game. In this exemplary embodiment, the user name can include hypertext links or other controls that allow other users to communicate directly with that user, configuration controls that allow the user to block such communications, or other suitable functionality.

Faro bet same as system 806 generates one or more user controls that allow a user to elect to place bets that are the same as bets placed by another player. In one exemplary embodiment, a user can select a player that has been identified as having a winning streak and can further select to place bets that are the same as that player. In this exemplary embodiment, the selection can be hidden from the winning player (so as to prevent the winning player from changing their betting selections in order to cause other players that have selected to bet the same as the winning player to lose), the selection can be displayed in a suitable manner (such as to show the number of other players that betting the same as the winning player), or other suitable status information can be displayed.

Faro team system 808 allows a user to form a team with other users. In one exemplary embodiment, Faro team system 808 can allow a user to join an existing team, such as by allowing the user to respond to an invitation to join the existing team from a current team member. In this exemplary embodiment, the team can be implemented as an object having associated graphical and metadata parameters, such as graphical parameters that identify team members and team members that are online, and metadata parameters that define team members that have administrative capabilities (such as to add or delete team members), that allow teams to score points and to participate in games or tournaments, and other suitable parameters. In another exemplary embodiment, an object can be instantiated by a user to form a team, such as by receiving usernames of other users that are to be invited to join the team, to allow the user to assign a team name to the team, or to provide other suitable functions.

Faro daily tournament system 810 coordinates games for two or more teams to participate in, such as a game that may be joined by one or more members of existing teams, a game that can be initiated by a first team that invites a second team to play, or in other suitable manners. In one exemplary embodiment, Faro daily tournament system 810 can be implemented as an object having graphical and metadata attributes, such as graphical attributes that populate a Faro game and provide the associated controls for the Faro game, metadata attributes that award points that are earned during the tournament to the team players, and other suitable attributes.

Figure 9:
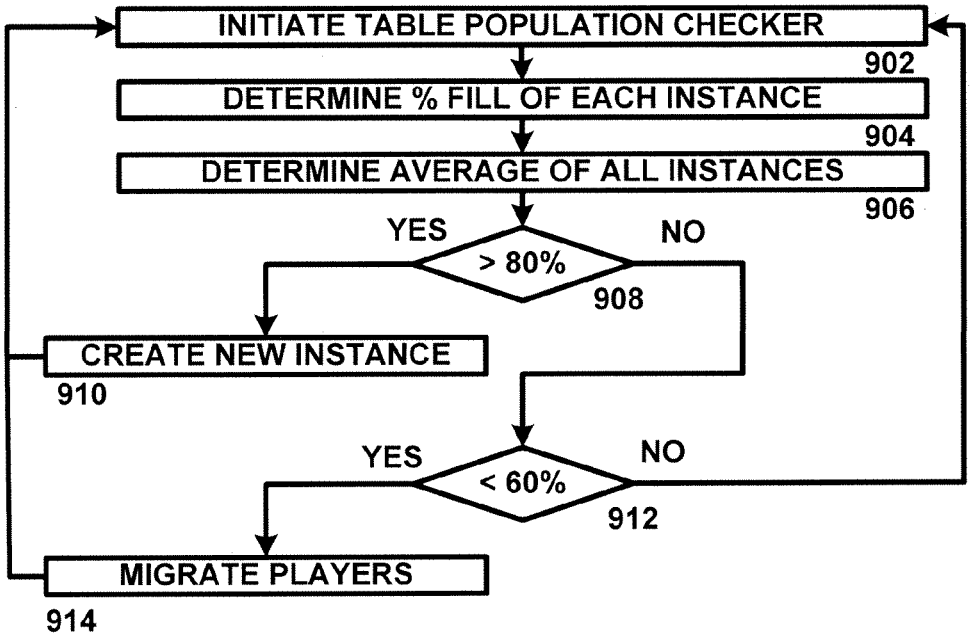
FIG. 9 is a flow chart of an algorithm for controlling instances of a Faro table in accordance with an exemplary embodiment of the present disclosure.

FIG. 9 is a flow chart of an algorithm 900 for controlling instances of a Faro table in accordance with an exemplary embodiment of the present disclosure. Algorithm 900 can be implemented in hardware, such as by using a plurality of integrated logic devices, or in a suitable combination of hardware and software, such as using software operating on a general purpose processor platform. Algorithm 900 can also or alternatively be implemented as a state diagram, where state transitions as shown, additional state transitions or alternative state transitions can be provided, as discussed herein.

Algorithm 900 begins at 902, where a table population checker is initiated. In one exemplary embodiment, the table population checker can be initiated based on a timing metric that is a function of table percentage fill, as discussed further herein. In this exemplary embodiment, as table fill increases, the frequency of table population checking can be increased. In another exemplary embodiment, different table population checker routines can be performed for different purposes, such as a first table population checker routine that is initiated every 5 to 10 seconds that checks for the need to start new instances of a table, and a second table population checker routine that is initiated every hour that checks for the need to shut down under-populated tables. The algorithm then proceeds to 904.

At 904, a percentage fill of each table instance is calculated. In one exemplary embodiment, a table instance can have a maximum number of players, such as 300, and the percentage fill can be determined based on the current number of players divided by the maximum number of players. The algorithm then proceeds to 906.

At 906, the average table instance percentage fill for all instances of a table is determined. In one exemplary embodiment, the average table instance percentage fill can be the simple average of the percentage fill for all instances of a table, or other suitable procedures can be used. The algorithm then proceeds to 908.

At 908, it is determined whether the average table instance percentage fill for all instances of a table is greater than 80%. If so, then the algorithm proceeds to 910, where a new instance of the table is initiated. In this exemplary embodiment, the new instance can have the same attribute of the table as existing instances, such as payout parameters, minimum bet parameters and maximum bet parameters, where new players are seamlessly placed into the new instance. The tale population checker timer interval can also or alternatively be increased or decreased at 910. The algorithm then returns to 902.

If it is determined at 908 that the average table instance percentage fill for all instances of a table is not greater than 80%, the algorithm proceeds to 912, where it is determined whether the average table instance percentage fill for all instances of a table is less than 60%, in which case the algorithm proceeds to 914. At 914, players are migrated from an instance of a table that has less then 60% to another instance of the table, such as by notifying all clients in a room instance that they will be migrated to a new room instance when the current game is over. The frequency of the table population checker can also be modified. The algorithm then returns to 902.

If it is determined at 908 that the average table instance percentage fill for all instances of a table is not less than 60%, then the algorithm proceeds to 902. The frequency of the table population checker can also be modified.

Although the exemplary embodiments disclosed herein are described in the context of a Faro gaming system, the disclosed functionality can also or alternatively be implemented for other gaming applications, shopping applications, social network applications or other suitable applications. For example, various onscreen graphical displays can be used in such other applications, so as to allow users to more effectively manipulate data in such applications.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A game system comprising:

a plurality of card rank icons configured to be generated on a user display, each card rank icon configured to graphically represent one of a plurality of types of cards;

a plurality of case keep icons configured to be generated on the user display, each case keep icon configured to graphically represent a number of cards of one rank that have been played in a game, wherein one or more of the case keep icons further comprises:

a denomination field configured to display a denomination of a card associated with the case keep icon; and a plurality of status indicators disposed around a periphery of the denomination field and configured to change from a first state to represent when a card having the associated denomination has not been played, to a second state to represent when a card having the associated denomination has been played;

a plurality of wager icons configured to be generated on a user display, each wager icon configured to graphically represent a bet on one or more of the card ranks by overlapping one, two or four of the card rank icons; and wherein the denomination field is a circle and the plurality of status indicators are arc segments disposed around the periphery of the circle.

2. The game system of claim 1 wherein the plurality of status indicators comprise four arc segments, and the four arc segments are configured to change from the first state to the second state in clockwise order.

3. The game system of claim 1 wherein the denomination field and the plurality of status indicators are configured to be hidden until a first card having a value of the denomination field is played.

4. The game system of claim 1 wherein the denomination field and the plurality of status indicators are configured to be hidden after each card having a value of the denomination field is played.

5. The game system of claim 1 wherein each of the case keep icons comprises a denomination field and a plurality of status indicators.

6. The game system of claim 1 wherein thirteen of the case keep icons represent card denominations in a standard playing card deck, and three of the case keep icons represent special card denominations.

7. A method for playing a game comprising:

generating, with a processor, a user display comprising a plurality of card rank icons, each card rank icon configured to graphically represent one of a plurality of types of cards;

generating, with the processor, a plurality of case keep icons in the user display, each case keep icon configured to graphically represent a number of cards of one rank that have been played in a game, wherein generating one or more of the case keep icons further comprises:

generating, with the processor, a denomination field configured to display a denomination of a card associated with the case keep icon by generating a circle; and generating, with the processor, a plurality of status indicators disposed around a periphery of the denomination field and configured to change from a first state to represent when a card having the associated denomination has not been played, to a second state to represent when a card having the associated denomination has been played, further comprising generating arc segments disposed around the periphery of the circle; and generating, with the processor, a plurality of wager icons on the user display, each wager icon configured to graphically represent a bet on one or more of the card ranks by overlapping one, two or four of the card rank icons.

8. The method of claim 7 wherein generating the plurality of status indicators comprises generating four are segments, and further comprising changing a state of the four arc segments from the first state to the second state in clockwise order.

9. The method of claim 7 wherein generating the denomination field and the plurality of status indicators is not performed until a first card having a value of the denomination field is played.

10. The method of claim 7 wherein generating the denomination field and the plurality of status indicators is terminated after each card having a value of the denomination field is played.

11. The method of claim 7 wherein generating the plurality of case keep icons comprises generating a denomination field and a plurality of status indicators for each of the plurality of case keep icons.

12. The method of claim 7 wherein thirteen of the case keep icons represent card denominations in a standard playing card deck, and three of the case keep icons represent special card denominations.

13. A method for playing a game comprising:

generating, with a processor, a user display comprising a plurality of card rank icons, each card rank icon configured to graphically represent one of a plurality of types of cards;

generating, with the processor, a plurality of case keep icons in the user display, each case keep icon configured to graphically represent a number of cards of one rank that have been played in a game, wherein generating one or more of the case keep icons further comprises:

generating, with the processor, a denomination field configured to display a denomination of a card associated with the case keep icon; and generating, with the processor, a plurality of status indicators disposed around a periphery of the denomination field and configured to change from a first state to represent when a card having the associated denomination has not been played, to a second state to represent when a card having the associated denomination has been played;

generating, with the processor, a random number;

selecting, with the processor, one of a set of available cards using the random number;

changing a status of the selected card from available to unavailable, with the processor; and changing a state of one of the plurality of status indicators for the denomination field associated with the selected card from the first state to the second state with the processor, by changing a color of an arc segment disposed around the periphery of the denomination field associated with the selected card from a first color to a second color.

14. The method of claim 13 further comprising:

generating a second random number;

selecting one of the set of available cards using the second random number;

changing a status of the second selected card from available to unavailable; and changing a state of a status indicator for the denomination field associated with the second selected card from the first state to the second state.

15. The method of claim 14 wherein changing the state of one of the plurality of status indicators for the denomination field associated with the second selected card from the first state to the second state comprises changing a color of an arc segment disposed around the periphery of the denomination field associated with the second selected card from a first color to a second color.

* * * * *

UNITED STATES PATENT AND TRADEMARK OFFICE

CERTIFICATE OF CORRECTION

PATENT NO. : 8,568,215 B1
APPLICATION NO. : 13/447132
DATED : October 29, 2013
INVENTOR(S) : Christie S. Tyler et al.

It is certified that error appears in the above-identified patent and that said Letters Patent is hereby corrected as shown below:

In the Claims

Column 16, line 41, replace “are” with “arc”

Signed and Sealed this
Thirty-first Day of December, 2013

Margaret A. Focarino

Margaret A. Focarino
*Commissioner for Patents of the United States Patent and Trademark Office*